US008143978B2

(12) United States Patent
Shen

(10) Patent No.: US 8,143,978 B2
(45) Date of Patent: Mar. 27, 2012

(54) ELECTROMECHANICAL RELAY AND METHOD OF OPERATING SAME

(75) Inventor: Jun Shen, Phoenix, AZ (US)

(73) Assignee: Magvention (Suzhou), Ltd., Suzhou (CN)

( * ) Notice: Subject to any disclaimer, the term of this patent is extended or adjusted under 35 U.S.C. 154(b) by 0 days.

(21) Appl. No.: 12/709,465

(22) Filed: Feb. 20, 2010

(65) Prior Publication Data

US 2010/0214044 A1 Aug. 26, 2010

Related U.S. Application Data

(60) Provisional application No. 61/154,435, filed on Feb. 23, 2009.

(51) Int. Cl.
*H01H 51/22* (2006.01)

(52) U.S. Cl. ..... 335/80; 335/78; 335/79; 335/81; 335/124; 335/128; 335/177; 335/179; 335/181

(58) Field of Classification Search ..... 335/78–86, 335/124, 128, 177–181
See application file for complete search history.

(56) References Cited

U.S. PATENT DOCUMENTS 4,668,928 A * 5/1987 Davis et al. ..... 335/79
5,475,353 A * 12/1995 Roshen et al. ..... 335/78
5,818,316 A * 10/1998 Shen et al. ..... 335/78
6,124,650 A * 9/2000 Bishop et al. ..... 310/40 MM
6,469,603 B1 * 10/2002 Ruan et al. ..... 335/78
6,492,887 B1 * 12/2002 Diem et al. ..... 335/78
6,512,435 B2 * 1/2003 van Namen ..... 335/234
6,633,158 B1 * 10/2003 Shen et al. ..... 324/207.26
7,342,473 B2 * 3/2008 Joung et al. ..... 335/78
2004/0027218 A1 * 2/2004 Stafford et al. ..... 335/78
2005/0046531 A1 * 3/2005 Moyer et al. ..... 335/256
2005/0078429 A1 * 4/2005 Lee ..... 361/160
2007/0075809 A1 * 4/2007 Shen et al. ..... 335/78

* cited by examiner

*Primary Examiner* — Mohamad Musleh

(57) ABSTRACT

An electromechanical relay employing a movable first magnet and a nearby switching electromagnet is disclosed. The movable first magnet is permanently magnetized with a magnetic moment and has at least a first end. The switching electromagnet, when energized, produces a switching magnetic field which is primarily perpendicular to the magnetization direction of the first movable magnet and exerts a magnetic torque on the first magnet to force the first magnet to rotate and closes an electrical conduction path at the first end. Changing the direction of the electrical current in the switching electromagnet changes the direction of the switching magnetic field and thus the direction of the magnetic torque on the first magnet, and causes the first magnet to rotate in an opposite direction and opens the electrical conduction path at the first end. Multiple magnetic layers can be arranged to form closed magnetic circuits to facilitate switching and maintaining switched states. Latching and non-latching types of relays can be formed by appropriately adjusting various force magnitudes.

15 Claims, 3 Drawing Sheets

Top view.

Front view.

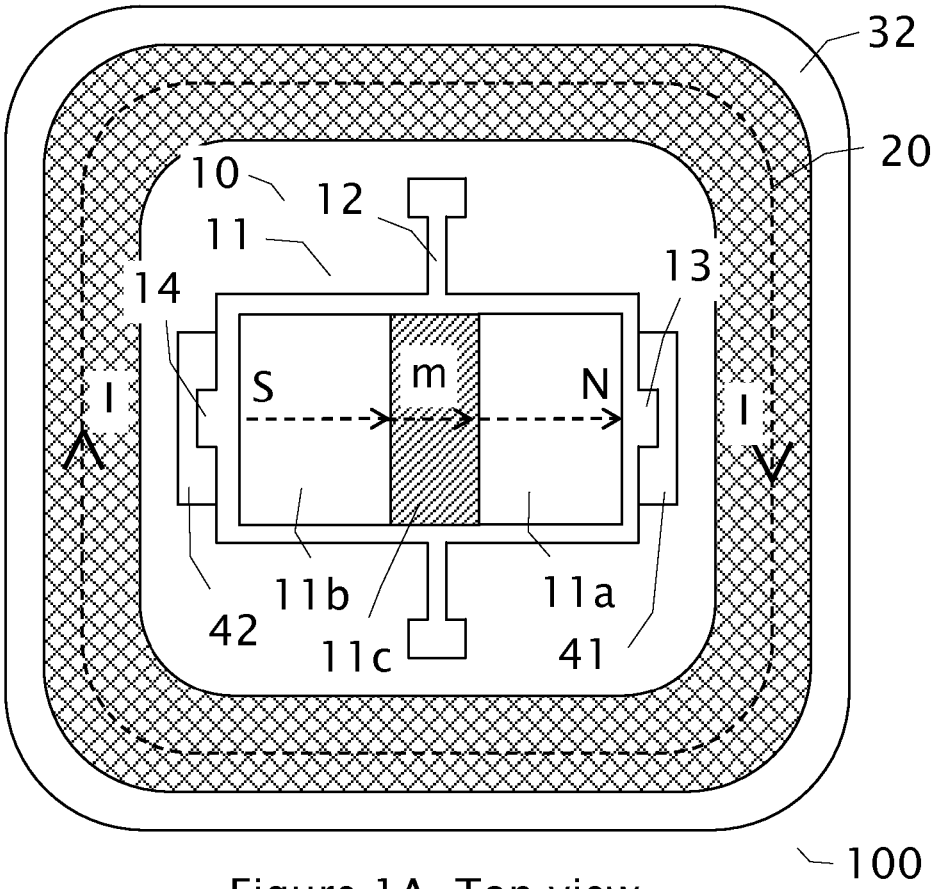
Figure 1A. Top view.
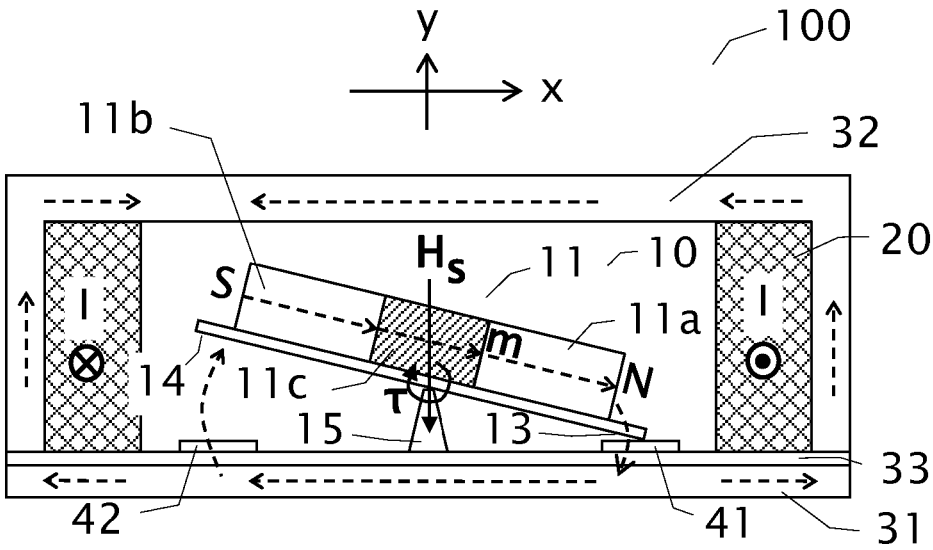
Figure 1B. Front view.

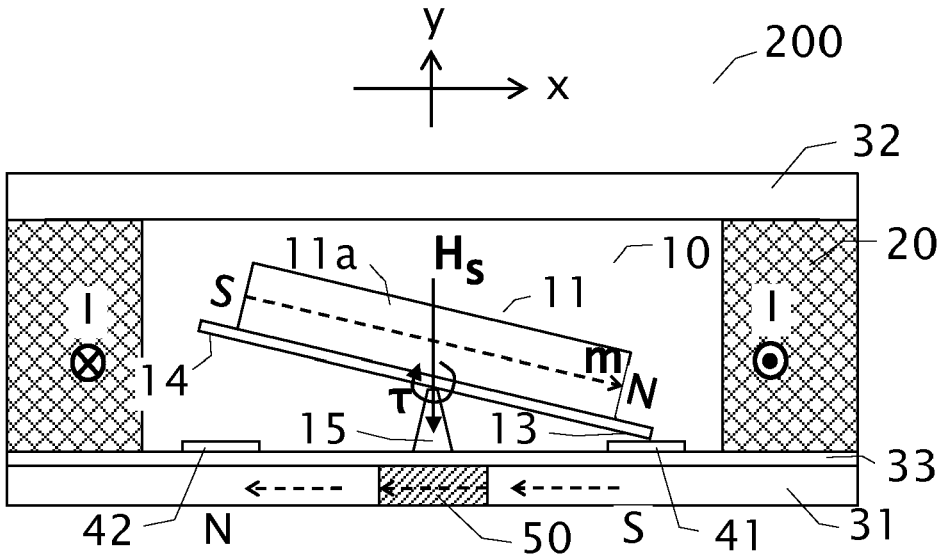
Figure 2. Front view.
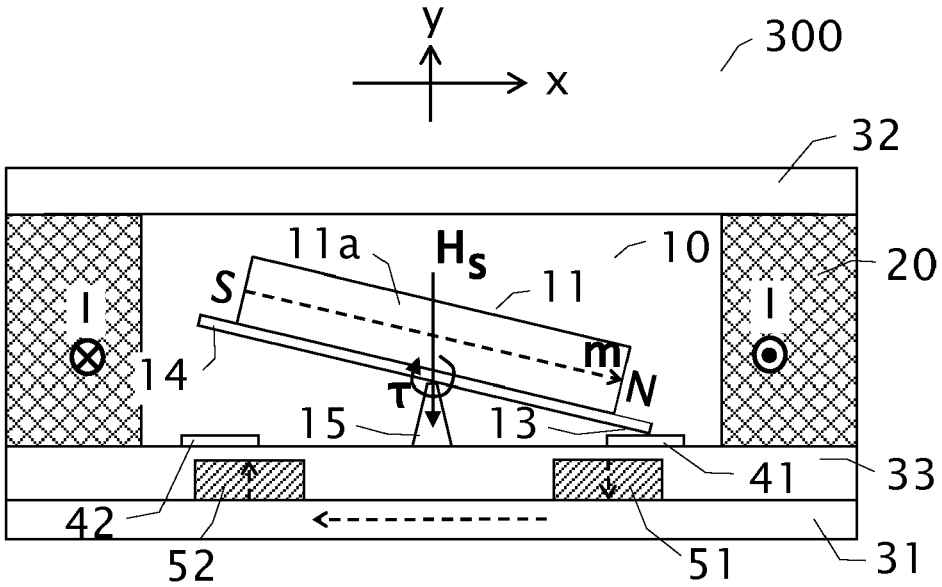
Figure 3. Front view.

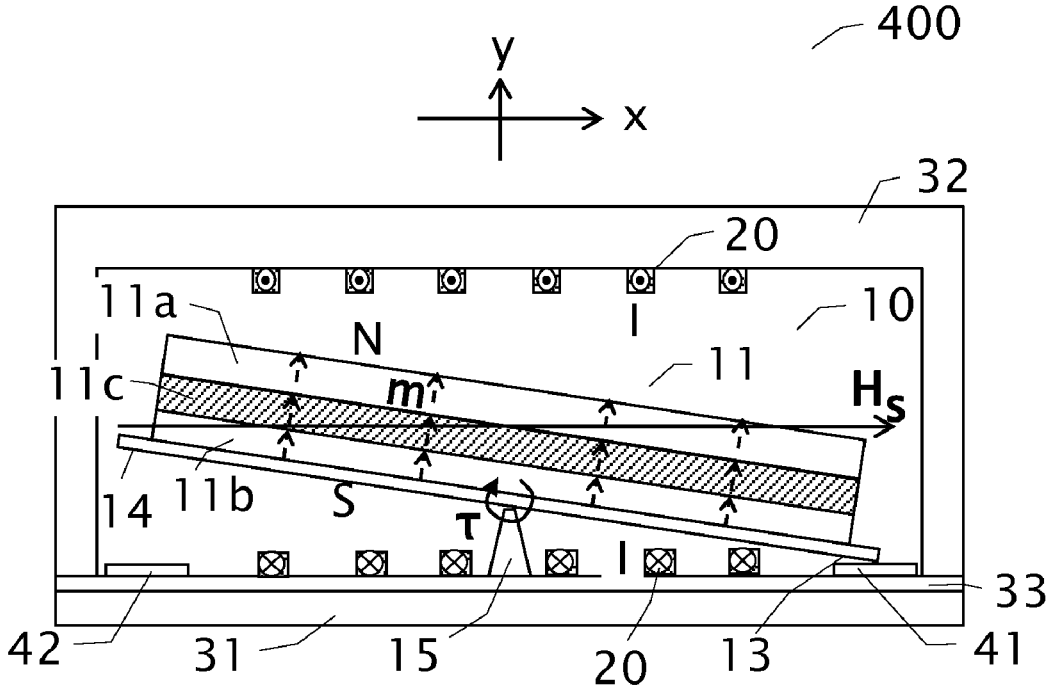
Figure 4. Front view.

ELECTROMECHANICAL RELAY AND METHOD OF OPERATING SAME

CROSS-REFERENCE TO RELATED APPLICATIONS

This patent application claims the benefit of U.S. Provisional Patent Application Ser. No. 61/154,435, filed on Feb. 23, 2009, which is hereby incorporated by reference. This application is related to application Ser. No. 11/534,655, filed on Sep. 24, 2006, now U.S. Pat. No. 7,482,899 B2, issued on Jan. 27, 2009.

FIELD OF THE INVENTION

The present invention relates to relays. More specifically, the present invention relates to electromechanical relays and to methods of operating and formulating electromechanical relays.

BACKGROUND OF THE INVENTION

Relays are electromechanical switches operated by a flow of electricity in one circuit controlling the flow of electricity in another circuit. A typical relay consists basically of an electromagnet with a soft iron bar, called an armature, held close to it. A movable contact is connected to the armature in such a way that the contact is held in its normal position by a spring. When the electromagnet is energized, it exerts a force on the armature that overcomes the pull of the spring and moves the contact so as to either complete or break a circuit. When the electromagnet is de-energized, the contact returns to its original position. Variations on this mechanism are possible: some relays have multiple contacts; some are encapsulated; some have built-in circuits that delay contact closure after actuation; some, as in early telephone circuits, advance through a series of positions step by step as they are energized and de-energized, and some relays are of latching type.

Latching relays are the types of relays which can maintain closed or open contact positions without energizing an electromagnet. Short current pulses are used to temporally energize the electromagnet and switch the relay from one contact position to the other. An important advantage of latching relays is that they do not consume power (actually they do not need a power supply) in the quiescent state.

Conventional electromechanical relays have traditionally been fabricated one at a time, by either manual or automated processes. The individual relays produced by such an "assembly-line" type process generally have relatively complicated structures and exhibit high unit-to-unit variability and high unit cost. Conventional electromechanical relays are also relatively large when compared to other electronic components. Size becomes an increasing concern as the packaging density of electronic devices continues to increase.

Many designs and configurations have been used to make latching electromechanical relays. Two forms of conventional latching relays are described in the Engineers' Relay Handbook (Page 3-24, Ref. [1]). A permanent magnet supplies flux to either of two permeable paths that can be completed by an armature. To transfer the armature and its associated contacts from one position to the other requires energizing current through the electromagnetic coil using the correct polarity. One drawback of these traditional latching relay designs is that they require the coil to generate a relatively large reversing magnetic field in order to transfer the armature from one position to the other. This requirement mandates a large number of wire windings for the coil, making the coil size large and impossible or very difficult to fabricate other than using conventional winding methods.

A non-volatile programmable switch is described in U.S. Pat. No. 5,818,316 issued to Shen et al. on Oct. 6, 1998, the entirety of which is incorporated herein by reference. The switch disclosed in this reference includes first and second magnetizable conductors having first and second ends, respectively, each of which is a north or south pole. The ends are mounted for relative movement between a first position in which they are in contact and a second position in which they are insulated from each other. The first conductor is permanently magnetized and the second conductor is switchable in response to a magnetic field applied thereto. Programming means are associated with the second conductor for switchably magnetizing the second conductor so that the second end is alternatively a north or south pole. The first and second ends are held in the first position by magnetic attraction and in the second position by magnetic repulsion.

Another latching relay is described in U.S. Pat. No. 6,469,602 B2 issued to Ruan et al. on Oct. 22, 2002 (claiming priority established by the Provisional Application No. 60/155,757, filed on Sep. 23, 1999), the entirety of which is incorporated herein by reference. The relay disclosed in this reference is operated by providing a cantilever sensitive to magnetic fields such that the cantilever exhibits a first state corresponding to the open state of the relay and a second state corresponding to the closed state of the relay. A first magnetic field may be provided to induce a magnetic torque in the cantilever, and the cantilever may be switched between the first state and the second state with a second magnetic field that may be generated by, for example, a conductor formed on a substrate with the relay.

Yet another non-volatile micro relay is described in U.S. Pat. No. 6,124,650 issued to Bishop et al. on Sep. 26, 2000, the entirety of which is incorporated herein by reference. The device disclosed in this reference employs square-loop latchable magnetic material having a magnetization direction capable of being changed in response to exposure to an external magnetic field. The magnetic field is created by a conductor assembly. The attractive or repulsive force between the magnetic poles keeps the switch in the closed or open state.

Each of the prior arts, though providing a unique approach to make latching electomechanical relays and possessing some advantages, has some drawbacks and limitations. Some of them may require large current for switching, and some may require precise relative placement of individual components. These drawbacks and limitations can make manufacturing difficult and costly, and hinder their value in practical applications.

Accordingly, it would be highly desirable to provide an easily switchable electromechanical relay which is also simple and easy to manufacture and use.

It is a purpose of the present invention to provide a new and improved electromechanical relay which can be easily configured as latching or non-latching types.

SUMMARY OF THE INVENTION

The above problems and others are at least partially solved and the above purposes and others are realized in a relay comprising a movable first magnet and a nearby switching electromagnet (e.g., a coil or solenoid). The movable first magnet is permanently magnetized and has at least a first end. The switching electromagnet, when energized, produces a switching magnetic field which is primarily perpendicular to the magnetization direction of the first movable magnet and exerts a magnetic torque on the first magnet to force the first magnet to rotate and closes an electrical conduction path at the first end. Changing the direction of the electrical current in the switching electromagnet changes the direction of the switching magnetic field and thus the direction of the magnetic torque on the first magnet, and causes the first magnet to rotate in an opposite direction and opens the electrical conduction path at the first end. The first magnet can comprise multiple magnetic layers to form relatively closed magnetic circuits with other magnetic components. Latching and non-latching types of relays can be formed by appropriately using soft and permanent magnets as various components.

BRIEF DESCRIPTION OF THE FIGURES

The above and other features and advantages of the present invention are hereinafter described in the following detailed description of illustrative embodiments to be read in conjunction with the accompanying figures, wherein like reference numerals are used to identify the same or similar parts in the similar views, and:

FIG. 1A is a top view of an exemplary embodiment of an electromechanical relay;

FIG. 1B is a front view of an exemplary embodiment of an electromechanical relay;

FIG. 2 is a front view of another exemplary embodiment of an electromechanical relay;

FIG. 3 is a front view of another exemplary embodiment of an electromechanical relay;

FIG. 4 is a front view of another exemplary embodiment of an electromechanical relay.

DETAILED DESCRIPTION OF EXEMPLARY EMBODIMENTS

It should be appreciated that the particular implementations shown and described herein are examples of the invention and are not intended to otherwise limit the scope of the present invention in any way. Indeed, for the sake of brevity, conventional electronics, manufacturing, and other functional aspects of the systems (and components of the individual operating components of the systems) may not be described in detail herein. Furthermore, for purposes of brevity, the invention is frequently described herein as pertaining to an electromagnetic relay for use in electrical or electronic systems. It should be appreciated that many other manufacturing techniques could be used to create the relays described herein, and that the techniques described herein could be used in mechanical relays, optical switches, fluidic control systems, or any other switching devices. Further, the techniques would be suitable for application in electrical systems, optical systems, consumer electronics, industrial electronics, wireless systems, space applications, fluidic control systems, medical systems, or any other application. Moreover, it should be understood that the spatial descriptions made herein are for purposes of illustration only, and that practical latching relays may be spatially arranged in any orientation or manner. Arrays of these relays can also be formed by connecting them in appropriate ways and with appropriate devices.

FIGS. 1A and 1B show top and front views, respectively, of an electromechanical relay. With reference to FIGS. 1A and 1B, an exemplary electromechanical relay 100 suitably comprises a movable cantilever 10, a coil 20, soft magnetic layers 31 and 32, electrical contacts 41 and 42, and a substrate 33.

Movable cantilever 10 comprises a magnetic body 11 (first magnet), flexure spring and support 12, a pivot 15, and electrical contacts 13 and 14. Magnetic body 11 (first magnet) comprises a permanent (hard) magnetic layer 11*c*, soft magnetic layers 11*a* and 11*b*. Permanent magnetic layer 11*c* is permanently magnetized primarily along the positive x-axis when said magnetic layer 11*c* lies leveled. Other magnetization orientation of magnetic layer 11*c* is also possible as long as it achieves the function and purpose of this invention. Soft magnetic layers 11*a* and 11*b* are affixed to the right side and left side of permanent magnetic layer 11*c*, respectively. Cantilever 10 has a first (right) end associated with the first (right) end of first magnet 11 and contact 13, and has a second (left) end associated with the second (left) end of first magnet 11 and contact 14. Permanent magnetic layer 11*c* can be any type of hard magnetic material that can retain a remnant magnetization in the absence of an external magnetic field and its remnant magnetization cannot be easily demagnetized. In an exemplary embodiment, permanent magnetic layer 11*c* is a SmCo permanent magnet with an approximate remnant magnetization ($B_r=\mu_0 M$) of about 1 T predominantly along the positive x-axis when it lies leveled. Other possible hard magnetic materials are, for example, NdFeB, AlNiCo, Ceramic magnets (made of Barium and Strontium Ferrite), CoPtP alloy, and others, that can maintain a remnant magnetization ($B_r=\mu_0 M$) from about 0.001 T (10 Gauss) to above 1 T ($10^4$ Gauss), with coercivity ($H_c$) from about $7.96\times10^2$ A/m (10 Oe) to above $7.96\times10^5$ A/m ($10^4$ Oe). Soft magnetic layers 11*a* and 11*b* can be any magnetic material which has high permeability (e.g., from about 100 to above $10^5$) and can easily be magnetized by the influence of an external magnetic field. Examples of these soft magnetic materials include permalloy (NiFe alloys), Iron, Silicon Steels, FeCo alloys, soft ferrites, etc. Soft magnetic layers 11*a* and 11*b* are magnetized by permanent magnet 11*c* to form a north pole at the right end and a south pole on the left. First magnet 11 has a combined magnetic moment m predominantly along the positive x-axis when first magnet 11 lies leveled. Magnetizations in permanent magnet 11*c*, soft magnetic layers 11*a* and 11*b* all contribute to the combined magnetic moment m in first magnet 11. Flexure spring and support 12 can be any flexible material that on one hand supports cantilever 10 and on the other allows cantilever 10 to be able to move and rotate. Flexure spring and support can be made of metal layers (such as Beryllium Copper, Ni, stainless steel, etc.), or non-metal layers (such as polyimide, Si, $Si_3Ni_4$, etc.). The flexibility of the flexure spring can be adjusted by its thickness, width, length, shape, and elasticity, etc. Pivot 15 further supports the cantilever to maintain a gap between cantilever 10 and soft magnetic layer 31. Pivot 15 can be placed on the top of cantilever 10 to maintain a gap between cantilever 10 and soft magnetic layer 32. Electrical contacts 13 and 14 can be any electrically conducting layer such as Au, Ag, Rh, Ru, Pd, AgCdO, Tungsten, etc., or suitable alloys. Electrical contacts 13 and 14 can be formed onto the tips (ends) of cantilever 10 by electroplating, deposition, welding, lamination, or any other suitable means. Flexure spring and support 12 and electrical contacts 13 and 14 can be formed by either using one process and the same material, or by using multiple processes, multiple layers, and different materials. When cantilever 10 rotates and its two ends move up or down, electrical contact 13 (or 14) either makes or breaks the electrical connection with the bottom contact 41 (or 42). Optional insulating layers (not shown) can be placed between the conducting layers to isolate electrical signals in some cases.

Coil 20 (switching electromagnet) is formed by having multiple windings of conducting wires around cantilever 10. The conducting wires can be any conducting materials such as Cu, Al, Au, or others. The windings can be formed by either winding the conducting wires around a bobbin, or by electroplating, deposition, screen printing, etching, laser forming, or other means used in electronics industry (e.g., semiconductor integrated circuits, printed circuit boards, etc.). One purpose of coil 20 in relay 100, when energized, is to provide a switching vertical (along y-axis) magnetic field ($H_s$) so that a magnetic torque ($\tau=\mu_0 m \times H_s$) can be created on cantilever 10. Because the magnetic moment m in first magnet 11 is fixed, the direction and magnitude of the torque depends on the direction and magnitude of the current in coil 20. This arrangement provides a means for external electronic control of the relay switching between different states, as to be explained in detail below.

Soft magnetic layers 31 (second magnet) and 32 can be any magnetic material which has high permeability (e.g., from about 100 to above $10^5$) and can easily be magnetized by the influence of an external magnetic field. Examples of these soft magnetic materials include permalloy (NiFe alloys), Iron, Silicon Steels, FeCo alloys, soft ferrites, etc. One purpose of soft magnetic layers 31 and 32 is to form a closed magnetic circuit (indicated by dashed lines with arrows in FIG. 1B) and enhance the coil-induced magnetic flux density (switching vertical magnetic field $H_s$) in the cantilever region. Another purpose of soft magnetic layers 31 and 32 is to cause an attractive force between a pole of first magnetic layer 11 and the induced local opposite magnetic pole of the soft magnetic layer so that a stable contact force can be maintained between electrical contact 13 (or 14) and electrical contact 41 (or 42) when the latching feature is desired. Yet another purpose of soft magnetic layers 31 and 32 is to confine the magnetic field inside the cavity enclosed by soft magnetic layers 31 and 32 so that the magnetic interference between adjacent devices can be eliminated or reduced. The distance between soft magnetic layer 31 (or 32) and first magnet 11 can be adjusted to alter the attractive force between the magnetic poles of magnet 11 and the soft magnetic layer 31 (or 32). Openings can also be suitably formed in soft magnetic layers 31 and 32 to achieve the same purpose.

Electrical contacts 41 and 42 can be any electrically conducting layer such as Au, Ag, Rh, Ru, Pd, AgCdO, Tungsten, etc., or suitable alloys. Electrical contacts 41 and 42 can be formed on a substrate 33 by electroplating, deposition, screen printing, welding, lamination, or any other suitable means. Optional insulating layers (not shown) can be placed between the conducting layers to isolate electrical signals in some cases. Transmission-line types of contacts and metal traces can also be suitably designed and formed for high performance radio-frequency applications.

Substrate 33 can be any suitable structural material (plastic, ceramics, semiconductors, metal coated with thin films, etc.).

In a broad aspect of the invention, an electromagnet 20, when energized, produces a switching magnetic field which is primarily perpendicular to the magnetization direction of first movable magnet 11 and exerts a magnetic torque on first magnet 11 to force first magnet 11 and cantilever 10 to rotate and close an electrical conduction path at one end (e.g., first end) of cantilever 10. Changing the direction of the electrical current in switching electromagnet 20 changes the direction of the switching magnetic field and thus the direction of the magnetic torque on first magnet 11, and causes first magnet 11 and cantilever 10 to rotate in an opposite direction and opens the electrical conduction path at the end (e.g., first end) of cantilever 10 and closes the electrical conduction path at the other end (e.g., second end).

With continued reference to FIGS. 1A and 1B, first magnet 11 is permanently magnetized horizontally (along positive x-axis) with a combined magnetization moment m. Cantilever 10 can have three basic stable positions: (a) the first (right) end down (as shown); (b) the second (left) end down; and (c) neutral (approximately leveled) position. When a current passes through coil 20 (switching electromagnet) as shown in FIG. 1B going into (circle with a cross) the paper on the left side and out (circle with a dot) from the paper on the right), a perpendicular switching magnetic field ($H_s$, the solid line with an arrow pointing downward in this case) about first magnet 11 is produced. The switching magnetic field $H_s$ interacts with first magnet 11 and exerts a magnetic torque ($\tau=\mu_0 m \times H_s$) on first magnet 11 and causes magnet 11 and cantilever 10 to rotate clockwise until contact 13 touches contact 41 on the right-hand side, closing the electrical conduction path between contact 13 and contact 41. On the other hand, when the direction of the current in coil 20 is opposite to the direction shown in FIGS. 1A and 1B, the magnetic torque ($\tau$) on first magnet 11 is counterclockwise and causes first magnet 11 and cantilever 10 to rotate counterclockwise until contact 14 touches contact 42 on the left-hand side, closing the electrical conduction path between contact 14 and contact 42 and opening the electrical conduction path between contact 13 and contact 41. Soft magnetic layers 31 and 32 wrap around coil 20 to form a closed magnetic circuit and enhance the coil-induced magnetic flux density (switching vertical magnetic field) in cantilever 10 region. When electromagnet 20 is not energized, cantilever 10 can be in the neutral (leveled) position and maintained in that position by the restoring spring force of spring and support 12 and pivot 15, or remained in one of the tilted states (one end down) when the magnetic attraction between that end of first magnet 11 and soft magnetic layers 31 and 32 is strong enough to hold it there.

Some of the aforementioned advantages of the disclosed invention can be evidenced by the following exemplary analysis.

EXAMPLE 1

Assuming the first magnet having the following characteristics:

length=4 mm (along long axis), width=4 mm, thickness=0.2 mm, volume V=length×width×thickness, remnant magnetization $B_r=\mu_0 M=1$ T, the magnetic moment $\mu_0 m=\mu_0 M \times V=3.2\times10^{-9}$ T·m$^3$. For a coil-induced magnetic field $\mu_0 H_s=0.05$ T ($H_s=500$ Oe), the induced magnetic torque about the length center is $\tau=\mu_0 m \times H_s=1.27\times10^{-4}$ m·N (assuming m is perpendicular to $H_s$) which corresponds to a force of $F_m=\tau/(\text{length}/2)=6.4\times10^{-2}$ N at the end of the first magnet. The above exemplary parameters show that for a relatively small coil-induced magnetic field ($H_s=500$ Oe), a significantly large torque and force can be generated. The torque and force can continue to increase with larger $H_s$ (correspondingly larger coil current). Another point worth noting is that when the angle between m and $H_s$ changes from perfectly perpendicular (90°) to 80°, the change in the magnitude of the torque (and force) is only 1.5%=1−98.5%=1−sin(80°), which gives a larger tolerance in production variations, simplifies the production process, and reduces costs.

FIG. 2 shows another exemplary embodiment of an electromechanical relay. In this embodiment, relay 200 comprises a movable cantilever 10, a coil 20, soft magnetic layers 31 and 32, electrical contacts 41 and 42, and a permanent magnetic layer 50.

Movable cantilever 10 comprises a magnetic body 11 (first magnet), flexure spring and support 12, a pivot 15, and electrical contacts 13 and 14. Magnetic body 11 (first magnet)

comprises a soft magnetic layer 11*a* which can be any magnetic material which has high permeability (e.g., from about 100 to above $10^5$) and can easily be magnetized by the influence of an external magnetic field. Cantilever 10 has a first (right) end associated with the first (right) end of first magnet 11 and contact 13, and has a second (left) end associated with the second (left) end of first magnet 11 and contact 14. A permanent magnetic layer 50 is placed in between two separate sections of soft magnetic layer 31. Permanent magnetic layer 50 can be any hard permanent magnetic material with the same material attributes as permanent magnet 11*c* in FIG. 1. Permanent magnet 50 is permanently magnetized primarily along the negative x-axis. Soft magnetic layer 31 is magnetized by permanent magnet 50 and forms a local south pole near the first (right) end of first magnet 11 and a north pole near the second (left) end of first magnet 11 (magnetic flux lines are indicated by the dashed lines with arrows), which subsequently magnetizes first magnet 11 and induces a magnetic moment m in first magnet 11 predominantly along the positive x-axes. In this case, permanent magnet 50, the left-hand section of soft magnetic layer 31, first magnet 11, the right-hand section of soft magnetic layer 31 forms a closed magnetic circuit (the dashed lines with arrows indicating the magnetic flux directions). An electromagnet 20, when energized, produces a switching magnetic field ($H_s$) which is primarily perpendicular to the magnetization direction of first movable magnet 11 and exerts a magnetic torque on first magnet 11 to force first magnet 11 and cantilever 10 to rotate and close an electrical conduction path at one end (e.g., first end) of cantilever 10. Changing the direction of the electrical current in switching electromagnet 20 changes the direction of the switching magnetic field and thus the direction of the magnetic torque on first magnet 11, and causes first magnet 11 and cantilever 10 to rotate in an opposite direction and opens the electrical conduction path at one end (e.g., first end) of cantilever 10 and closes the electrical conduction path at the other end (e.g., second end).

With continued reference to FIG. 2, cantilever 10 can have three basic stable positions: (a) the first (right) end down (as shown); (b) the second (left) end down; and (c) neutral (approximately leveled) position. When a current passes through coil 20 (switching electromagnet) as shown in FIG. 2 going into (circle with a cross) the paper on the left side and out (circle with a dot) from the paper on the right), a perpendicular switching magnetic field ($H_s$, the solid line with an arrow pointing downward in this case) about first magnet 11 is produced. The switching magnetic field $H_s$ interacts with first magnet 11 and exerts a magnetic torque ($\tau=\mu_0 m \times H_s$) on first magnet 11 and causes magnet 11 and cantilever 10 to rotate clockwise until contact 13 touches contact 41 on the right-hand side, closing the electrical conduction path between contact 13 and contact 41. On the other hand, when the direction of the current in coil 20 is opposite to the direction shown in FIG. 2, switching magnetic field $H_s$ would be pointing along positive y-axis while the magnetic moment m in first magnet 11 still remaining largely unchanged and pointing predominantly along positive x-axis, producing a counterclockwise magnetic torque ($\tau=\mu_0 m \times H_s$) on first magnet 11 and causing first magnet 11 and cantilever 10 to rotate counterclockwise until contact 14 touches contact 42 on the left-hand side, closing the electrical conduction path between contact 14 and contact 42 and opening the electrical conduction path between contact 13 and contact 41.

When electromagnet 20 is not energized, cantilever 10 can be in the neutral (leveled) position and maintained in that position by the restoring spring force of spring and support 12 and pivot 15, or remains in one of the tilted states (one end down) when the magnetic attraction between that end of first magnet 11 and soft magnetic layer 31 (and/or permanent magnet 50) is strong enough to hold it there.

FIG. 3 shows another exemplary embodiment of an electromechanical relay. In this embodiment, relay 300 comprises a movable cantilever 10, a coil 20, soft magnetic layers 31 and 32, electrical contacts 41 and 42, and permanent magnetic layers 51 and 52.

Movable cantilever 10 comprises a magnetic body 11 (first magnet), flexure spring and support 12, a pivot 15, and electrical contacts 13 and 14. Magnetic body 11 (first magnet) comprises a soft magnetic layer 11*a* which can be any magnetic material which has high permeability (e.g., from about 100 to above $10^5$) and can easily be magnetized by the influence of an external magnetic field. Cantilever 10 has a first (right) end associated with the first (right) end of first magnet 11 and contact 13, and has a second (left) end associated with the second (left) end of first magnet 11 and contact 14. Permanent magnetic layers 51 and 52 are placed near the first (right) end and second (left) end of first magnet 11 respectively, and in between first magnet 11 and soft magnetic layer 31. Permanent magnetic layers 51 and 52 can be any hard permanent magnetic material with the same material attributes as permanent magnet 11*c* in FIG. 1. Permanent magnet 51 is permanently magnetized primarily along the negative y-axis and permanent magnet 52 is permanently magnetized primarily along the positive y-axis (as indicated by the dashed arrows). Permanent magnets 51 and 52 magnetizes soft magnetic layer 31 and first magnet 11 and induces a magnetic moment m in first magnet 11 predominantly along the positive x-axes. In this case, permanent magnet 51, soft magnetic layer 31, permanent magnet 52, and first magnet 11 form a closed (with small gaps) magnetic circuit (the dashed lines with arrows indicating the magnetic flux directions). An electromagnet 20, when energized, produces a switching magnetic field which is primarily perpendicular to the magnetization direction of first movable magnet 11 and exerts a magnetic torque on first magnet 11 to force first magnet 11 and cantilever 10 to rotate and close an electrical conduction path at one end (e.g., first end) of cantilever 10. Changing the direction of the electrical current in switching electromagnet 20 changes the direction of the switching magnetic field and thus the direction of the magnetic torque on first magnet 11, and causes first magnet 11 and cantilever 10 to rotate in an opposite direction and opens the electrical conduction path at one end (e.g., first end) of cantilever 10 and closes the electrical conduction path at the other end (e.g., second end).

With continued reference to FIG. 3, cantilever 10 can have three basic stable positions: (a) the first (right) end down (as shown); (b) the second (left) end down; and (c) neutral (approximately leveled) position. When a current passes through coil 20 (switching electromagnet) as shown in FIG. 3 going into (circle with a cross) the paper on the left side and out (circle with a dot) from the paper on the right), a perpendicular switching magnetic field ($H_s$, solid line with an arrow pointing downward in this case) about first magnet 11 is produced. The switching magnetic field $H_s$ interacts with first magnet 11 and exerts a magnetic torque ($\tau=\mu_0 m \times H_s$) on first magnet 11 and causes magnet 11 and cantilever 10 to rotate clockwise until contact 13 touches contact 41 on the right-hand side, closing the electrical conduction path between contact 13 and contact 41. On the other hand, when the direction of the current in coil 20 is opposite to the direction shown in FIG. 3, the magnetic torque ($\tau$) on first magnet 11 is counterclockwise and causes first magnet 11 and cantilever 10 to rotate counterclockwise until contact 14 touches contact 42 on the left-hand side, closing the electrical conduction path between contact 14 and contact 42 and opening the electrical conduction path between contact 13 and contact 41.

When electromagnet 20 is not energized, cantilever 10 can be in the neutral (leveled) position and maintained in that position by the restoring spring force of spring and support 12 and pivot 15, or remains in one of the tilted states (one end down) when the magnetic attraction between that end of first magnet 11 and a permanent magnet (51 or 52) is strong enough to hold it there.

FIG. 4 shows another exemplary embodiment of an electromechanical relay. In this embodiment, relay 400 comprises a movable cantilever 10, a coil 20, soft magnetic layers 31 and 32, and electrical contacts 41 and 42.

Movable cantilever 10 comprises a magnetic body 11 (first magnet), flexure spring and support 12, a pivot 15, and electrical contacts 13 and 14. Magnetic body 11 (first magnet) comprises a permanent (hard) magnetic layer 11*c*, soft magnetic layers 11*a* and 11*b*. Permanent magnetic layer 11*c* is permanently magnetized primarily along the positive y-axis when magnet 11*c* lies leveled. Soft magnetic layers 11*a* and 11*b* are affixed to the upper side and lower side of permanent magnetic layer 11*c*, respectively. Cantilever 10 has a first (right) end associated with the first (right) end of first magnet 11 and contact 13, and has a second (left) end associated with the second (left) end of first magnet 11 and contact 14. Soft magnetic layers 11*a* and 11*b* are magnetized by permanent magnet 11*c* to form a north pole at the upper end and a south pole at the lower end. First magnet 11 has a combined magnetic moment m predominantly along the positive y-axis when first magnet 11 lies leveled. Magnetizations in permanent magnet 11*c*, soft magnetic layers 11*a* and 11*b* all contribute to the combined magnetic moment m in first magnet 11. An electromagnet 20, when energized, produces a switching magnetic field ($H_s$) which is primarily perpendicular to the magnetization direction of first movable magnet 11 and exerts a magnetic torque on first magnet 11 to force first magnet 11 and cantilever 10 to rotate and close an electrical conduction path at one end (e.g., first end) of cantilever 10. Changing the direction of the electrical current in switching electromagnet 20 changes the direction of the switching magnetic field and thus the direction of the magnetic torque on first magnet 11, and causes first magnet 11 and cantilever 10 to rotate in an opposite direction and opens the electrical conduction path at one end (e.g., first end) of cantilever 10 and closes the electrical conduction path at the other end (e.g., second end).

With continued reference to FIG. 4, cantilever 10 can have three basic stable positions: (a) the first (right) end down (as shown); (b) the second (left) end down; and (c) neutral (approximately leveled) position. When a current passes through coil 20 (switching electromagnet) as shown in FIG. 4 going into (circle with a cross) the paper on the lower side and out (circle with a dot) from the paper on the upper side, a horizontal switching magnetic field ($H_s$, solid line with an arrow pointing along positive x-axis in this case) about first magnet 11 is produced. The switching magnetic field $H_s$ interacts with first magnet 11 and exerts a magnetic torque ($\tau=\mu_0 m \times H_s$) on first magnet 11 and causes first magnet 11 and cantilever 10 to rotate clockwise until contact 13 touches contact 41 on the right-hand side, closing the electrical conduction path between contact 13 and contact 41. On the other hand, when the direction of the current in coil 20 is opposite to the direction shown in FIG. 4, switching magnetic field $H_s$ would be pointing along negative x-axis while the magnetic moment m in first magnet 11 still remaining largely unchanged and pointing predominantly along positive y-axis, producing a counterclockwise magnetic torque ($\tau=\mu_0 m \times H_s$) on first magnet 11 and causing first magnet 11 and cantilever 10 to rotate counterclockwise until contact 14 touches contact 42 on the left-hand side, closing the electrical conduction path between contact 14 and contact 42 and opening the electrical conduction path between contact 13 and contact 41.

When electromagnet 20 is not energized, cantilever 10 can be in the neutral (leveled) position and maintained in that position by the restoring spring force of spring and support 12 and pivot 15, or remains in one of the tilted states (one end down) when the magnetic attraction between that end of first magnet 11 and soft magnetic layer 31 (and/or soft magnetic layer 32) is strong enough to hold it there.

It is understood that a variety of methods can be used to fabricate the electromechanical relay. These methods include, but not limited to, semiconductor integrated circuit fabrication methods, printed circuit board fabrication methods, micro-machining methods, and so on. The methods include processes such as photo lithography for pattern definition, deposition, plating, screen printing, etching, lamination, molding, welding, adhering, bonding, and so on. The detailed descriptions of various possible fabrication methods are omitted here for brevity.

It will be understood that many other embodiments and combinations of different choices of materials and arrangements could be formulated without departing from the scope of the invention. Similarly, various topographies and geometries of the electromechanical relay could be formulated by varying the layout of the various components.

The corresponding structures, materials, acts and equivalents of all elements in the claims below are intended to include any structure, material or acts for performing the functions in combination with other claimed elements as specifically claimed. Moreover, the steps recited in any method claims may be executed in any order. The scope of the invention should be determined by the appended claims and their legal equivalents, rather than by the examples given above.

REFERENCE

[1] Engineers' Relay Handbook, 5th Edition, published by National Association of Relay Manufacturers, 1996.
[2] U.S. Pat. No. 5,818,316, Shen et al.
[3] U.S. Pat. No. 6,469,602 B2, Ruan and Shen.
[4] U.S. Pat. No. 6,124,650, Bishop et al.
[5] U.S. Pat. No. 6,469,603 B1, Ruan and Shen.
[6] U.S. Pat. No. 5,398,011, Kimura et al.
[7] U.S. Pat. No. 5,847,631, Taylor and Allen.
[8] U.S. Pat. No. 6,094,116, Tai et al.
[9] U.S. Pat. No. 6,084,281, Fullin et al.
[10] U.S. Pat. No. 5,475,353, Roshen et al.
[11] U.S. Pat. No. 5,703,550, Pawlak et al.
[12] U.S. Pat. No. 5,945,898, Judy et al.
[13] U.S. Pat. No. 6,143,997, Feng et al.
[14] U.S. Pat. No. 6,794,965 B2, Shen et al.
[15] U.S. Pat. No. 7,482,899 B2.

What is claimed is:

1. A magnetic device, comprising:

a substrate;

a movable body attached to said substrate having a rotational axis, said movable body having at least a first end and comprising a first magnet having a first permanent magnet layer with a permanent magnetization moment, said first magnet further comprising at least a first soft magnetic layer wherein said first permanent magnet layer having surface area substantially equal to surface area of said first soft magnet layer and wherein said first permanent magnet layer and said first soft magnet layer being laminated together; wherein said movable body comprising at least a movable electrical contact;

a switching magnet having a coil engaging said first magnet, wherein passing a current through said coil generating a switching magnetic field which has a main component primarily perpendicular to said permanent magnetization moment in a region where said switching magnetic field goes through first magnet, whereby a vector-cross product of said switching magnetic field and said permanent magnetization moment producing a torque on said first magnet and causing said movable body to rotate about said rotational axis;

wherein said switching magnet is controllable to cause said movable body settling in at least one stable state related to said substrate.

2. A magnetic device according to claim 1, wherein said at least one stable state is selected from:

a) said movable body rotated by said switching magnetic field in which said first end of said movable body is moved toward said substrate in a first stable position; or b) said movable body rotated by said switching magnetic field in which said first end of said movable body is moved away from said substrate in a second stable position.

3. A magnetic device according to claim 1, wherein said first magnet further comprising a second soft magnet layer wherein said second magnet layer having surface area substantially equal to surface area of said first soft magnet layer.

4. A magnetic device according to claim 1, said substrate comprising at least a stationary electrical contact.

5. A magnetic device according to claim 4, wherein said movable electrical contact being in contact with said stationary electrical contact when said movable body being in said first stable position; and said movable electrical contact being apart from said stationary electrical contact when said movable body being in said second stable position.

6. A magnetic device according to claim 1 which is an electromechanical relay.

7. A magnetic device according to claim 1, wherein said first permanent magnet layer being laminated on top of said first soft magnet layer such that said first soft magnet layer being closer to said substrate than said first permanent magnet layer.

8. A method of operating an electromechanical relay, comprising the steps of:

providing a substrate comprising at least a stationary electrical contact;

providing a movable body having a rotational axis, said movable body having at least a movable electrical contact and comprising a first magnet having a first permanent magnet layer with a permanent magnetization moment, said first magnet further comprising at least a first soft magnetic layer wherein said first permanent magnet layer having surface area substantially equal to surface area of said first soft magnet layer and wherein said first permanent magnet layer and said first soft magnet layer being laminated together; wherein said movable body comprising at least a movable electrical contact;

providing a switching magnet having a coil engaging said first magnet, wherein passing a current through said coil generating a switching magnetic field which has a main component primarily perpendicular to said permanent magnetization moment in a region where said switching magnetic field goes through first magnet, whereby a vector-cross product of said switching magnetic field and said permanent magnetization moment producing a torque on said first magnet and causing said movable body to rotate about said rotational axis;

wherein said switching magnet is controllable to cause said movable electrical contact to either touch or break away from said stationary electrical contact.

9. A method of operating an electromechanical relay according to claim 8, wherein said first permanent magnet layer being laminated on top of said first soft magnet layer such that said first soft magnet layer being closer to said substrate than said first permanent magnet layer.

10. A magnetic device comprising;

a substrate;

a movable body attached to said substrate having a rotational axis, said movable body having at least a first end and comprising a first magnet having a first permanent magnet with a permanent magnetization moment, said first magnet further comprising at least a first soft magnetic element; wherein said movable body comprising at least a movable electrical contact;

a switching magnet having a coil, wherein passing a current through said coil generating a switching magnetic field which has a main component primarily perpendicular to said permanent magnetization moment in a region where said switching magnetic field goes through first magnet, whereby of said switching magnetic field and said permanent magnetization moment producing a torque on said first magnet and causing said movable body to rotate about said rotational axis;

wherein said switching magnet is controllable to cause said movable body settling in at least one stable state related to said substrate;

wherein said first magnet further comprising a second soft magnetic element; and wherein said first magnet comprises said first permanent magnet being sandwiched by said first and second soft magnet elements.

11. A magnetic device according to claim 10, said first permanent magnet being sandwiched by said first and second soft magnet elements in such a way that said first and second soft magnet elements being in distal ends of said first magnet.

12. A magnetic device according to claim 10, said first permanent magnet, said first and second soft magnet elements being a layered structure that said first permanent magnet being a middle layer sandwiched by said first and second soft magnet layers.

13. A magnetic device according to claim 10, wherein said at least one stable state is selected from:

a) said movable body rotated by said switching magnetic field in which said first end of said movable body is moved toward said substrate in a first stable position; or b) said movable body rotated by said switching magnetic field in which said first end of said movable body is moved away from said substrate in a second stable position.

14. A magnetic device according to claim 10, said substrate comprising at least a stationary electrical contact.

15. A magnetic device according to claim 14, wherein said movable electrical contact being in contact with said stationary electrical contact when said movable body being in said first stable position; and said movable electrical contact being apart from said stationary electrical contact when said movable body being in said second stable position.

* * * * *